United States Patent [19]

Yamaji

[11] Patent Number: 5,051,782

[45] Date of Patent: Sep. 24, 1991

[54] ELECTROSTATIC LATENT IMAGE DEVELOPING APPARATUS

[75] Inventor: Masaaki Yamaji, Tokyo, Japan

[73] Assignee: Canon Kabushiki Kaisha, Tokyo, Japan

[21] Appl. No.: 531,161

[22] Filed: May 31, 1990

[30] Foreign Application Priority Data

May 31, 1989 [JP] Japan ..... 1-138776

[51] Int. Cl.[5] ..... G03G 15/09

[52] U.S. Cl. ..... 355/251; 118/658; 355/253

[58] Field of Search ..... 355/251, 253, 245; 118/657, 658

[56] References Cited

U.S. PATENT DOCUMENTS

| | | | |
|---|---|---|---|
| 4,583,490 | 4/1986 | Kan et al. | 118/658 |
| 4,825,241 | 4/1989 | Saijo et al. | 118/657 X |
| 4,887,131 | 12/1989 | Kinoshita et al. | 355/253 |
| 4,928,146 | 5/1990 | Yamada | 355/253 |
| 4,960,070 | 10/1990 | Nishimura | 118/658 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A developing apparatus for developing an electrostatic latent image formed on an image bearing member includes a rotatable developer carrying member for being supplied with developer in a developer container and for carrying the developer through a developing zone. A magnet is stationarily disposed in the developer carrying member. The magnet has a first magnetic pole for forming a magnetic field in the developing zone, a second magnetic pole disposed downstream thereof with respect to a rotational direction of the developer carrying member and having a magnetic polarity opposite thereto, and a third magnetic pole disposed downstream of the second magnetic pole with respect to the direction and disposed adjacent to the second magnetic pole. The second magnetic pole has a magnetic flux density satisfying $$(X50/X0) > (Y50/Y0)$$

where X0 is a distance from a position $B_p$ of a maximum magnetic flux density of a one pole to a boundary between the one pole and the upstream adjacent magnetic pole, measured along the circumference of the developer carrying member; Y0 is a distance from the position $B_p$ to a boundary between the one magnetic pole and the downward adjacent magnetic pole, measured along the circumferential periphery of the developer carrying member; X50 and Y50 are distances from the position $B_p$ to the upstream and downstream positions where the magnetic flux density by the one magnetic pole is one half the maximum magnetic flux density, measured along the circumferential periphery of the developer carrying member.

11 Claims, 5 Drawing Sheets

ELECTROSTATIC LATENT IMAGE DEVELOPING APPARATUS

FIELD OF THE INVENTION AND RELATED ART

The present invention relates to a developing apparatus usable with an image forming apparatus such as an electrophotographic copying machine or an electrostatic recording machine, more particularly to a developing apparatus using a developer containing magnetic material.

Various proposals have been made as to the developing apparatus using a developer containing magnetic material. A typical one includes a developer container containing a developer and a rotatable developer carrying member in the form of a non-magnetic cylinder which will hereinafter be called "sleeve", wherein the sleeve encloses a magnet roller stationarily disposed therein, the magnet roller having a plurality of a magnetic poles. In such a developing apparatus, the developer is carried from the inside of the developer container by the rotation of the sleeve to a developing zone where the latent image is developed. The magnet roller has a magnetic pole at a position of the developing zone, wherein the sleeve is faced to the image bearing member to form a magnetic field (the magnetic pole will hereinafter be called "a developing magnetic pole)." In addition, it includes another magnetic pole downstream of the developing magnetic pole with respect to the rotational direction of the sleeve to convey the developer having passed through the developing zone back into the container. Said other magnetic pole will be called hereinafter "a conveying magnetic pole".

If the conveying magnetic pole is disposed at a position outside the developer container, the developer erected by the conveying magnetic pole is scattered. In order to prevent the scattering, the conveying magnetic pole is usually disposed within the container or covered with a covering member. Only from the standpoint of the prevention of the developer scattering, an end of the covering member is advantageously extended as upstream as possible of the conveying magnetic pole. However, the extension is necessarily limited in terms of the other members. Therefore, the developing magnetic pole and the conveying magnetic pole are made distant sufficiently from each other, and the conveying magnetic pole is sufficiently covered with a covering memmber To meet the recent demand for the high quality image, the size of the toner particles in a two component developer magnetic brush type development is used by which a high resolution and fine images are intended. However, simply by reducing the size of the toner particles, the toner supply power decreases, and therefore, it becomes necessary to reduce the size of the magnetic carrier particles. When the size of the magnetic carrier particles is reduced, they are more easily deposited on the image bearing member and are taken out of the developing apparatus. In order to prevent this, the magnetic flux density of the developing magnetic pole is increased to such an extent exceeding 900 Gauss on the sleeve, and in some instances exceeding 1000 Gauss. This necessitates that the magnetic flux density of the conveying magnetic pole is relatively smaller than that of the developing magnetic pole.

However, in the conventional apparatus, the developer conveying property is worsened because of the smaller maximum magnetic flux density of the conveying magnetic pole as compared with the maximum magnetic flux density of the developing magnetic pole. Then, the developer stagnates in the neighborhood of the developing zone, or the developer is not sufficiently returned into the developer container but overflows. In addition, the quality of the image is degraded, or the developer is scattered. Those problems tend to arise more when the two component developer containing a small size carrier and toner particles, and when the conveying magnetic pole is covered with the covering member.

The problems are increased when the developing magnetic pole and the conveying magnetic pole are made remote to the above described sufficient extent.

SUMMARY OF THE INVENTION

Accordingly, it is a principal object of the present invention to provide a developing apparatus wherein the developer conveying property is improved, and the developer is effective prevented from scattering.

It is another object of the present invention to provide a developing apparatus wherein the developer conveying property is improved, and the defects in the image can be prevented.

The developing apparatus according to an embodiment of the present invention, similarly to the conventional developing apparatus, comprises a developing magnetic pole and a conveying magnetic pole which is downstream of the developing magnetic pole with respect to the rotational direction of the developer carrying member and which is adjacent to the developing magnetic pole.

According to the embodiment of the present invention, the magnetic flux density distribution satisfies:

$$(X50/X0) > (Y50/Y0)$$

where X0 is a distance from a position Bp of a maximum magnetic flux density of a one pole to a boundary between the one pole and the upstream adjacent magnetic pole, measured along the circumference of the developer carrying member; Y0 is a distance from the position Bp to a boundary between the one magnetic pole and the downward adjacent magnetic pole, measured along the circumferential periphery of the developer carrying member; X50 and Y50 are distances from the position Bp to the upstream and downstream positions where the magnetic flux density by the one magnetic pole is one half the maximum magnetic flux density, measured along the circumferential periphery of the developer carrying member.

By doing so, even if the distance between the developing magnetic pole and the conveying magnetic pole is short, the developer is prevented from being scattered, and in addition, the developer conveying property is improved. The stagnation or the overflow of the developer adjacent to the developing zone attributable to the poor returning conveyance property toward the developer container, can be prevented.

In another embodiment of the present invention, the magnetic flux density distribution of the conveying pole satisfies $X0 < Y0$. That is, the maximum magnetic flux density position of the conveying pole is upstream of a geometrical center of the pole. By this, the conveying property from the developing pole to the conveying pole is further improved. Although this improves the developer conveying property, the brush of the developer formed by the conveying magnetic pole is, as the case may be, retracted to the developing pole with the result that the developer stagnates in the neighborhood of the developing zone. If this occurs, the problem of the developer scattering arises.

The consideration is made as to this problem, as follows: The maximum magnetic flux density of the developing pole is larger than the maximum magnetic flux density of the conveying pole, and therefore, between the developing pole and the conveying pole, the magnetic force is applied in the direction from the conveying pole to the developing pole. This magnetic force is f0.

The bottom portion of the developer on the developer carrying member receives a stronger retaining force on the carrying member such as electrostatic force. Therefore, this portion is conveyed by the developer carrying member against the magnetic force f0. However, the top portion of the developer in the brush erected adjacent to the conveying magnetic pole receives a smaller retaining force such as the electrostatic attraction force. Therefore, the developer is pulled back toward the developing pole. Accordingly, it is considered that the problems of the stagnation and scattering of the developer arise when the developer brush erected adjacent the conveying pole is within the range of the magnetic force $f\theta$ which is directed opposite to the movement direction of the developer carrying member and when the retaining force on the developer carrying member is smaller than the force $f\theta$.

To provide a solution to these problems, the position of the erection of the magnetic brush by the conveying pole is made remote from the region where the magnetic force $f\theta$ is influential.

According to a further embodiment of the present invention, the magnetic flux density distribution by the conveying pole satisfies $X0>Y0$, that is, the maximum flux density position of the magnetic pole is downstream of the geometrical center of the magnetic pole, by which the developer is prevented from being pulled back and from being scattered.

According to a yet further embodiment of the present invention, in order to prevent the developer from being pulled back and from being scattered, a means is provided to prevent movement of the developer in the brush erected by the conveying pole to the developing pole.

More particularly, the means includes a flexible seal contacted to the developer to prevent the developer from being pulled back and from being scattered, wherein a part of the seal is contacted to the developer at a position upstream of the maximum magnetic flux density position of the conveying pole with respect to the movement direction of the developer carrying member.

In this structure, the developer carrying member passes by the edge of the seal, but the developer erected at the maximum magnetic flux density position of the conveying pole is covered by the seal, so that even if the developer receives the retraction magnetic force $f\theta$, the seal is effective to stop it.

In a yet further embodiment of the present invention, the magnetic flux density distribution of the developing pole satisfies $X0<Y0$, by which the developer conveying property is improved.

The reason for this is considered as follows. By the magnetic flux density distribution of the developing magnetic pole satisfying $X0<Y0$, the area Y0 toward the downstream from the maximum magnetic flux density position of the magnetic flux density distribution by the developing magnetic pole is increased. Therefore, the inclination of the flux density in the downstream region can be reduced. Thus, the magnetic force in this region from the conveying magnetic pole toward the developing magnetic pole can be reduced.

According to a yet further embodiment of the present invention, the magnetic flux density distribution of the developing pole satisfies $(X50/X0) > (Y50/Y0)$, by which the conveyance property of the developer is improved.

In this Specification, the magnetic flux density is defined by the magnetic flux density in the direction perpendicular to the surface of the developer carrying member on the surface thereof.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
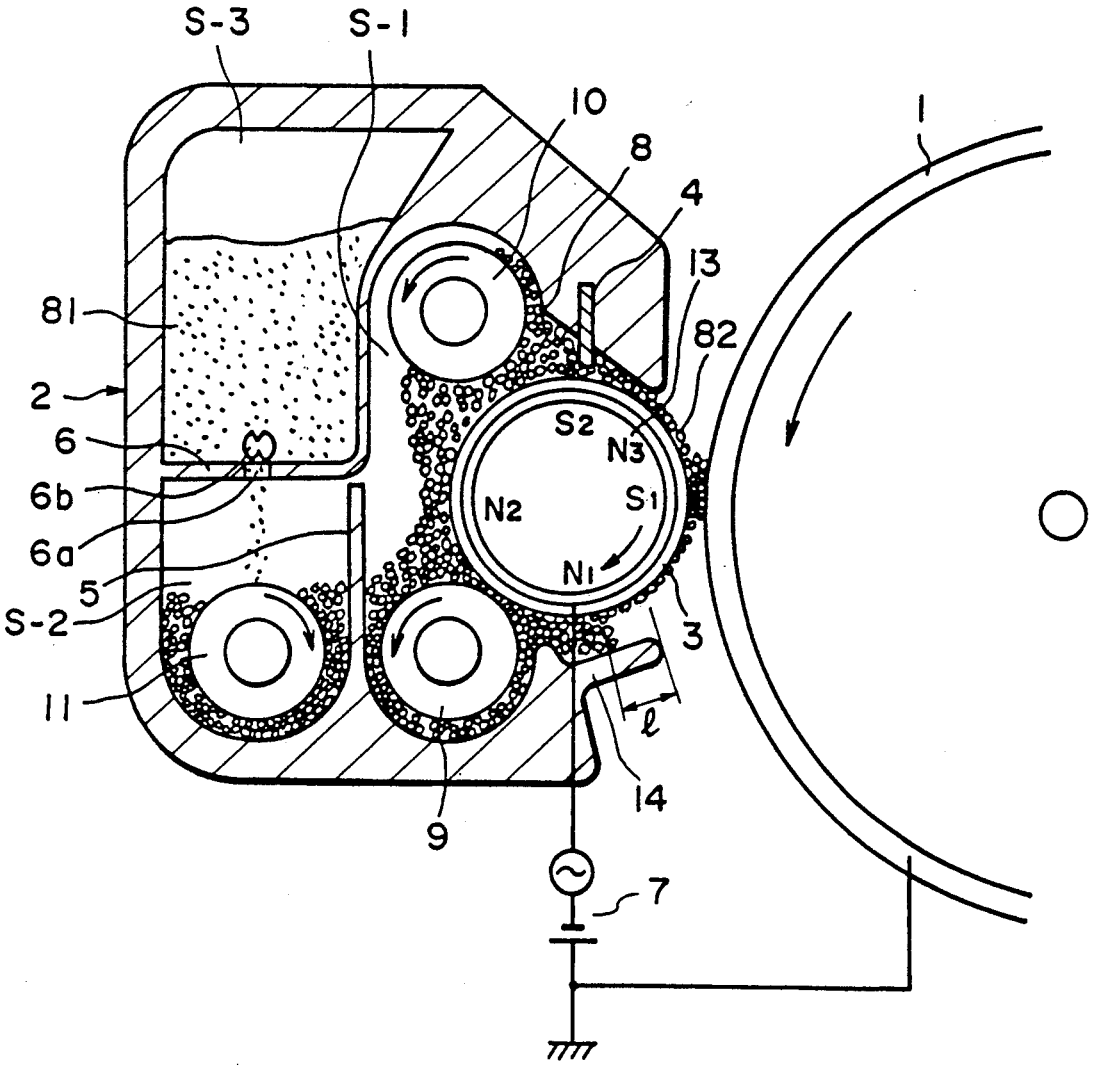
FIG. 1 is a cross-sectional view of a magnetic brush type developing apparatus according to an embodiment of the present invention.

Referring to FIG. 1, there is shown a developing apparatus according to an embodiment of the present invention. Designated by a reference numeral 1 is an electrophotographic photosensitive drum 1 rotatable in the direction indicated by an arrow. Around the photosensitive drum, there are disposed known electrophotographic process means including a charger, an image exposure means, an image transfer eans, a cleaning means and electric discharge means. Those means are known and omitted from FIG. 1 for the sake of simplicity.

The magnetic brush type developing apparatus 2 in this embodiment functions to develop a latent image formed on the photosensitive drum 1. It comprises a developer container 2 containing the developer 8, a developing sleeve 3 functioning as the developer carrying member and a blade 4 for regulating the thickness of the developer layer formed on the sleeve 3.

The developer container 2 is provided with an opening, in which the developing sleeve 3 is rotatably supported, and adjacent to the upper part of the developing sleeve 3, the blade 4 is mounted with a predetermined clearance from the sleeve 3.

The developing sleeve 3 is made of nonmagnetic material, and it rotates in the direction of arrow in FIG. 1 during the developing operation to carry the developer thereon. Within the sleeve 3, a magnet 13 is stationarily disposed. The magnet 13 has magnetic poles S1, N1, N2, S2 and N3 in the order named along the rotational direction of the sleeve. Here, the reference character including "S" means that it is an S pole, and "N" means that it is an N pole. The magnetic polarities of the magnetic poles may be opposite from those shown in FIG. 1.

The magnetic pole S1 is the developing magnetic pole to form a magnetic field in the developing zone. The magnetic field forms a magnetic brush of the developer contacted to the photosensitive drum 1 in the developing zone. In the present invention, in order to suppress the carrying-over of the carrier particles by the deposition onto the drum 1, it is preferable that the maximum magnetic flux density by the magnetic pole S1 on the sleeve surface is at least 900 Gauss, preferably at least 1000 Gauss. The magnetic pole N1 is the conveying pole for conveying the developer having passed through the developing zone. Because the maximum magnetic flux density of the magnetic pole S1 is great, the maximum magnetic flux density of the pole N1 on the sleeve surface is smaller than that of the pole S1. The magnetic pole N2 functions to attract the developer in the container onto the sleeve 3 surface. The magnetic poles S2 and N3 are effective to convey the developer toward the developing zone.

The blade 4 is made of non-magnetic material such as aluminum, and is mounted to the container with a predetermined clearance from the surface of the developing sleeve 3, as described hereinbefore. The clearance functions to regulate the thickness of the developer 8 layer on the developing sleeve 3, that is, the quantity of the developer 8 conveyed to the developing zone on the developing sleeve 3. In this embodiment, the developer 8 is a two component developer comprises non-magnetic toner particles 81 and magnetic carrier particles 82, and therefore, both of the non-magnetic toner particles and magnetic particles are passed through the clearance between the free end of the blade 4 and the developing sleeve 3 surface, toward the developing zone.

In the present invention, the layer of the developer is preferably thin. Therefore, the preferable clearance between the blade 4 and the sleeve 3 surface is 50–900 microns. If it is smaller than 50 microns, the developer is more easily clogged in the clearance with the result of a non-uniform thickness of the developer layer, and on the other hand, if it is larger than 900 microns, the quantity of the developer discharged from the container to is large. This results in the quantity of the carrier particles deposited on the drum 3 and taken out of the developing apparatus tends to increase in the case wherein an alternating electric field is formed in the developing zone.

The non-magnetic toner 81 preferably has a volume average particle size of not more than 12 microns and not less than 4 microns, and the preferably not more than 12 microns. In this embodiment, the used toner have a volume average particle size of approximately 8 microns. The volume average particle size is measured by the Coulter Counter TA-II (available from Coulter Electronics Incorporated) using an aperture of 100 microns, for example.

The counter is connected with an interface (available from Nikkaki Kabushiki Kaisha, Japan) outputting the number average distribution and volume average distribution, and is connected with CX-i personal computer (available from Canon Kabushiki Kaisha, Japan). A 1% NaCl water solution is prepared using a first class natrium chloride.

Into 100–150 ml of the electrolytic solution, 0.1–5 ml of a surface active agent as the dispersing agent, preferably an alkylbenzene sulfonate acid salt, is added, and 0.5–50 mg of the material to be tested is added thereto. The electrolytic solution suspending the material to be tested is subjected to a dispersion treatment for approximately 1–3 min. by an ultrasonic disperser. The above-mentioned counter is used with an aperture of 100 microns to measure the particle size distribution in the range of 2–40 microns, and the volume average distribution is obtained.

From the volume average distribution, the volume average particle size can be obtained.

When the toner 81 described above is used, the magnetic carrier particles 82 having the weight average particle size of 20–65 microns are usable. In this embodiment, the weight average particle size of the magnetic particles used was approximately 50 microns. The weight average particle size is measured using a mesh. The particles passed through 300/400 mesh were 80%, and the particles passed through 300/350 mesh were 75%. The magnetic particles are made of ferrite particles coated with extremely thin resin material, and the specific permeability was 5.0.

To the developing sleeve 3, an alternating bias voltage is applied from the voltage source 7. The alternating bias voltage has two peaks such that the light portion potential and the dark portion potential of the laten image are between the two peaks. Preferably, the alternating bias voltage is biased with a DC voltage having a voltage level between the light portion potential and the dark portion potential of the latent image. By the application of the alternating bias voltage, an electric field having alternating direction in short periods is formed in the developing zone. By this, the toner and carrier particles are vibrated, by which the release of the toner particles from the surfaces of the carrier particles and the surface of the sleeve 3 are promoted, so that the development efficiency is increased.

As described hereinbefore, in the alternating electric field, the end portions of the magnetic brush contacted to the drum in the developing zone tends to be torn with the result that small diameter carrier particles are easily deposited and retained on the photosensitive drum. In order to prevent this, it is desired that the maximum magnetic flux density of the developing magnetic pole S1 is increased. If this is done, the developer conveying power decreases. However, the present invention makes it possible to avoid this.

The developer having passed through the developing zone is carried on the sleeve 3 to the conveying magnetic pol N1.

The developing apparatus is provided with a covering member 14 which is disposed with a predetermined clearance from the developing sleeve 3 surface and is extended upstream to the position where the magnetic flux density on the sleeve by the conveying pole N1 is a maximum. In this embodiment, the distance 1 from the end of the covering member 14 and the maximum magnetic flux density position by the conveying pole N1 is 1 mm.

The developer formed into the magnetic brush by the conveying pole N1 is sufficiently covered by the covering member 14, so that the developer is prevented from scattering out side the developer container.

In FIG. 1, the conveying pole N1 and the immediately downstream second conveying pole N2 have the same magnetic polarity so that a repelling magnetic field is produced therebetween. Therefore, the developer conveyed to the conveying pole N1 on the sleeve 3 is removed from the sleeve 3 by the repelling magnetic field and is stirred and mixed by the first conveying means 9, and thereafter, a fresh developer is supplied onto the sleeve 3 surface adjacent the magnetic pole N2.

Thus, the developer on the sleeve which has the development hysteresis is removed from the sleeve surface by the repelling magnetic field, and is sufficiently mixed with the fresh developer, and they are supplied onto the sleeve 3. Accordingly, stabilized and good images can be provided.

The inside of the developer container 2 is partitioned by a wall 5 extending in the direction perpendicular to the sheet of the drawing into a developer chamber (first chamber) S-1 and a stirring chamber (second chamber) S-2. Above the stirring chamber S-2, a toner accommodating chamber S-3 is defined by a partition wall 6. In the toner containing chamber S-3, a supply of toner (non-magnetic toner particles) 81 is contained. In the partition wall 6, a supply port 6*a* is formed. Through the support 6*a*, an amount, corresponding to the amount of the toner consumed by the developing operation, of the toner is supplied from the toner accommodating chamber S-3 to the stirring chamber S-2 by a toner supply roller 6*b*. In the developing chamber S-1 and the stirring chamber S-2, the developer 8 is accommodated. Adjacent the front and rear sides of the developer container 2 in FIG. 1, openings (not shown) are formed to provide communication between the developing chamber S-1 and the stirring chamber S-2.

In the developing chamber S-1, there are first conveying means 9 and second conveying means 10. The first conveying means 10 is disposed at the bottom of the developer container 2 adjacent to the developing sleeve 3 and is rotatable in the direction of an arrow to convey the developer 8 from the rear side to the front side in FIG. 1. The second conveying means 10 is disposed above the first conveying means 9 and rotates in the direction indicated by an arrow to convey the developer 8 from the front side to the rear side in FIG. 1.

In the stirring chamber S-2, third conveying means 11 is provided which is disposed substantially at the same horizontal level as the first conveying means and is rotatable in the direction indicated by an arrow to convey the developer 8 from the front side to the rear side in FIG. 1.

The first, second and third conveying means 9, 10 and 11 are in the form of spiral screws.

The experimental data are given in Table 1. The experiments were carried out under the following conditions:

Outer diameter of the developing sleeve: 32 mm

Peripheral speed of the photosensitive drum: 160 mm/sec

Peripheral speed of the developing sleeve: 210 mm/sec

The experiments have been carried out to check the developer conveying performance on the developing sleeve by the conveying magnetic pole N1 and the scattering of the developer, using various magnets.

In the Table 1, Example 3 used a scattering preventing sheet 12 shown in FIG. 4 in the developing apparatus of FIG. 1, which will be described in detail hereinafter. Example $\alpha$ used the conveying magnetic pole N1 and the immediately downstream second conveying magnetic pole which had the opposite magnetic polarities, as shown in FIG. 5, which will be described in detail hereinafter, too.

In Table 1, the distances X0, Y0 X50 and Y50 on the surface of the sleeve are indicated by an angle as seen from the center of the sleeve.

Figure 3:
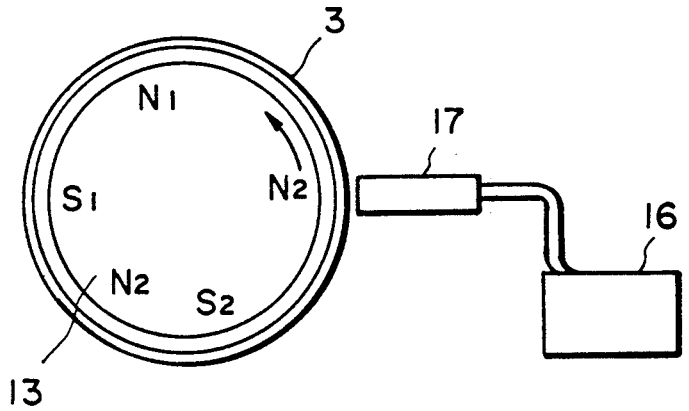
FIG. 3 illustrates the measuring method of the magnetic flux density in the direction normal to the surface of the sleeve

Referring to FIG. 3, the measuring method for the magnetic flux density in the direction normal to the surface of the sleeve 3. The Gauss meter model 640 available from Bell Corporation was used.

In FIG. 3, the sleeve 3 is fixed horizontally, and the magnet roller 13 is rotatable in the sleeve 3. An axial probe 17 is mounted with a small clearance with the sleeve 3 such that the center of the sleeve 3 and the center of the probe 17 are substantially on the same horizontal plane. The probe 17 is connected with the Gauss meter 16 to measure the magnetic flux density in the vertical direction on the sleeve 3.

The sleeve 3 and the magnet roller 13 are concentric, and the clearance between the sleeve 3 and the magnet roller 13 may be considered as being the same at any place. Therefore, by rotating the magnet roller 13, the magnetic flux density in the vertical direction of the sleeve can be measured at any circumferential position.

Figure 2:
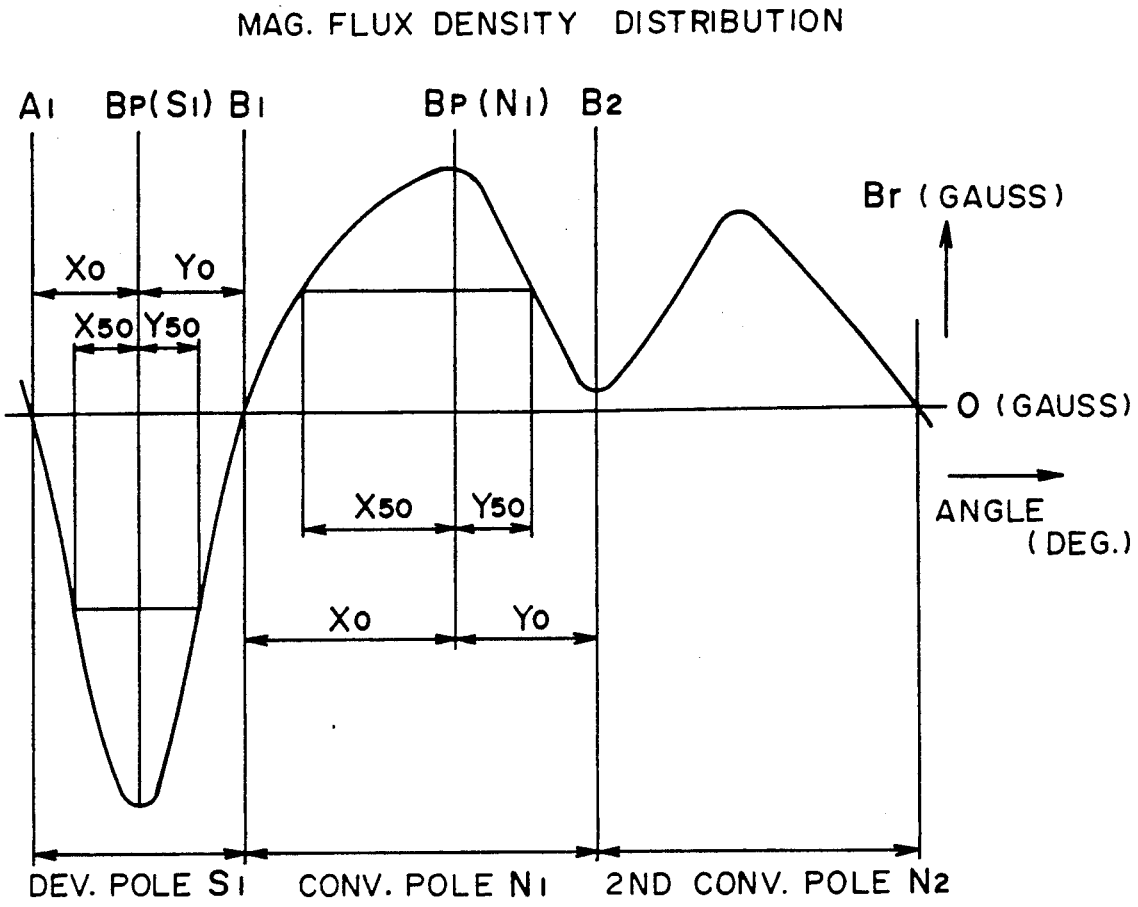
FIG. 2 illustrates the magnetic flux density distributions of the developing magnetic pole and the conveying magnetic pole.

The magnetic flux density distributions in the Examples 1–4 are as shown in FIG. 2. In FIG. 2, the ordinates represent the magnetic flux density on the developing sleeve 3, and the abscissa represents the circumferential position along the developing sleeve 3 surface by an angle as seen from the center of the sleeve.

Here, the description will be made as to the meaning of the magnetic pole. In the case of the developing magnetic pole of which adjacent magnetic poles at its either sides have the opposite polarity, the developing magnetic pole means the region between the position which is upstream of the maximum magnetic flux density position Bp (S1) of the developing magnetic pole and at which the magnetic flux density is 0 Gauss and the position which is downstream of the maximum magnetic flux density position Bp (S1) by the developing magnetic pole and at which the magnetic flux density is 0 Gauss. In the case of the conveying magnetic pole of which one of adjacent magnetic pole (downstream, for example) has the same polarity, the conveying magnetic pole means a region between a position which is upstream of the maximum magnetic flux density position Bp (N1) by the conveying magnetic pole and at which the magnetic flux density is 0 Gauss and a position which is downstream of the maximum magnetic flux density position Bp (N1) by the conveying magnetic pole and at which the magnetic flux density is minimum.

In other words, where the adjacent magnetic poles have the opposite polarity, the boundary is the 0 Gauss position of the magnetic flux density. Where the adjacent magnetic pole has the opposite polarity, the boundary is the position of the minimum magnetic flux density.

Referring to FIG. 2, the upstream boundary of the developing magnetic pole is designated by a reference A1; the upstream boundary of the conveying magnetic pole is designated by B1; and the downstream boundary of the conveying magnetic pole is designated by B2.

TABLE 1

| | MAGNET | MAX. FLUX DENSITY DEV. P (G) | CONV. P (G) | 2ND CONV. P (G) | DEV. P X0 (°) | Y0 (°) | X50 (°) | Y50 (°) | X50/X0 | Y50/Y0 |
|---|---|---|---|---|---|---|---|---|---|---|
| EX. 1 | A | −1020 | 550 | 530 | 27 | 30 | 10 | 16 | 0.67 | 0.53 |
| 2 | B | −1000 | 540 | 520 | 27 | 29 | 18 | 16 | 0.67 | 0.55 |
| 3 | B | −1000 | 540 | 520 | 27 | 29 | 18 | 16 | 0.67 | 0.55 |
| 4 | C | −1010 | 550 | −540 | 27 | 30 | 18 | 16 | 0.67 | 0.53 |
| COMP. EX. 1 | D | −1030 | 540 | 520 | 27 | 30 | 15 | 18 | 0.56 | 0.60 |

| | MAGNET | CONV. P X0 (°) | Y0 (°) | X50 (°) | Y50 (°) | X50/X0 | Y50/Y0 | ANGLE BETWEEN Ap−Bp (°) | EVALUATION CONV. REFORMATION | SCATTER PREVENTION |
|---|---|---|---|---|---|---|---|---|---|---|
| EX. 1 | A | 51 | 49 | 38 | 19 | 0.75 | 0.39 | 81 | E | E |
| 2 | B | 44 | 47 | 33 | 18 | 0.75 | 0.38 | 73 | E | F |
| 3 | B | 44 | 47 | 33 | 18 | 0.75 | 0.38 | 73 | E | E |
| 4 | C | 52 | 48 | 38 | 19 | 0.73 | 0.49 | 82 | E | E |
| COMP. EX. 1 | D | 49 | 42 | 23 | 24 | 0.47 | 0.57 | 79 | N | G |

In the Column of magnetic flux density, "−" means S pole, and "+" means N pole.
E: Excellent,
G: Good,
F: Fair,
N: No good.

In this embodiment, the conveying magnetic pole immediately downstream of the developing pole is covered with a covering member 14 for the purpose of preventing the toner scattering, but this is not good for the developer conveying performance. In addition, the magnetic flux density of the developing pole is made larger for the purpose of preventing the production of the foggy background and the prevention of the carrier deposition prevention, and therefore, the flux density of the conveying pole is fairly smaller than that of the developing pole. Therefore, the arrangement is such that the developer in the conveying pole is not easily conveyed.

In such an arrangement, the configuration of the magnetic flux density distribution by the conveying pole has been found to be significant. It has been found through experiments, as will be described in detail hereinafter, that when the configuration of the magnetic flux density distribution of the conveying pole is such that the magnetic flux density is made larger at its upstream side than at its downstream side, more particularly, when $(X50/X0)>(Y50/Y0)$, the developer is effectively prevented from the scattering, and the conveying performance of the developer is improved together with the advantages that the stagnation, leakage and the overflow of the developer can be prevented.

By this arrangement, the developer conveying performance from the developing pole to the conveying pole is improved. The reason is considered as follows. The magnetic force in the horizontal direction on the developing sleeve at the conveying pole is concerned. More particularly, the magnetic force by the conveying pole is deflected toward the developer conveying side.

The description will be made as to the Examples.

EXAMPLES 1 and 2

As will be understood from Table 1, the conveying performance is excellent in the Examples 1 and 2, and also, the quantity of the scattered developer is small. It is also understood that when the maximum magnetic flux density position by the conveying magnetic pole is placed downstream of the geometrical center of the conveying magnetic pole, as in Example 1, by which the conveying pole is remote from the developing pole, in other words, the magnetic flux density distribution of the conveying pole satisfies:

$$(X50/X0)>(Y50/Y0), \text{ and } X0>Y0$$

Then, the developer scattering is extremely small.

COMPARISON EXAMPLE 1

The structure is the same as in Example b 1 except for a developing roller D is used. As will be understood from Table 1, the developer conveying performance is no good, and in addition the developer is stagnated and overflown together with the disadvantage of the scattering of the developer.

Thus, the developer conveying performance is not good when the magnetic flux density distribution of the conveying pole which is immediately downstream of the developing magnetic pole having the maximum magnetic flux density satisfies:

$$(X50/X0)<(Y50/Y0)$$

EXAMPLE 3

Figure 4:
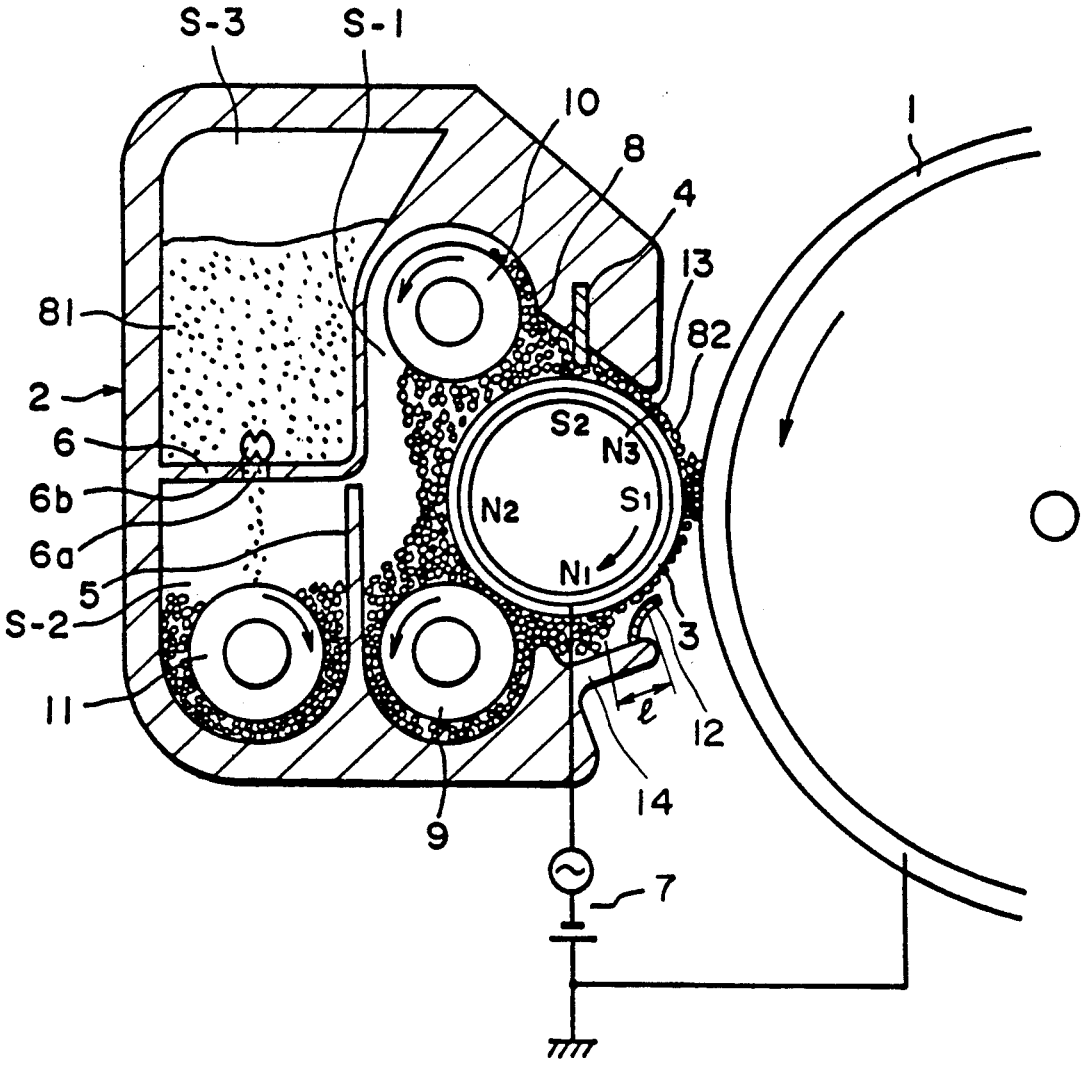
FIGS. 4 and 5 are cross-sectional views of magnetic brush type developing apparatuses according to other embodiments of the present invention.
Figure 5:
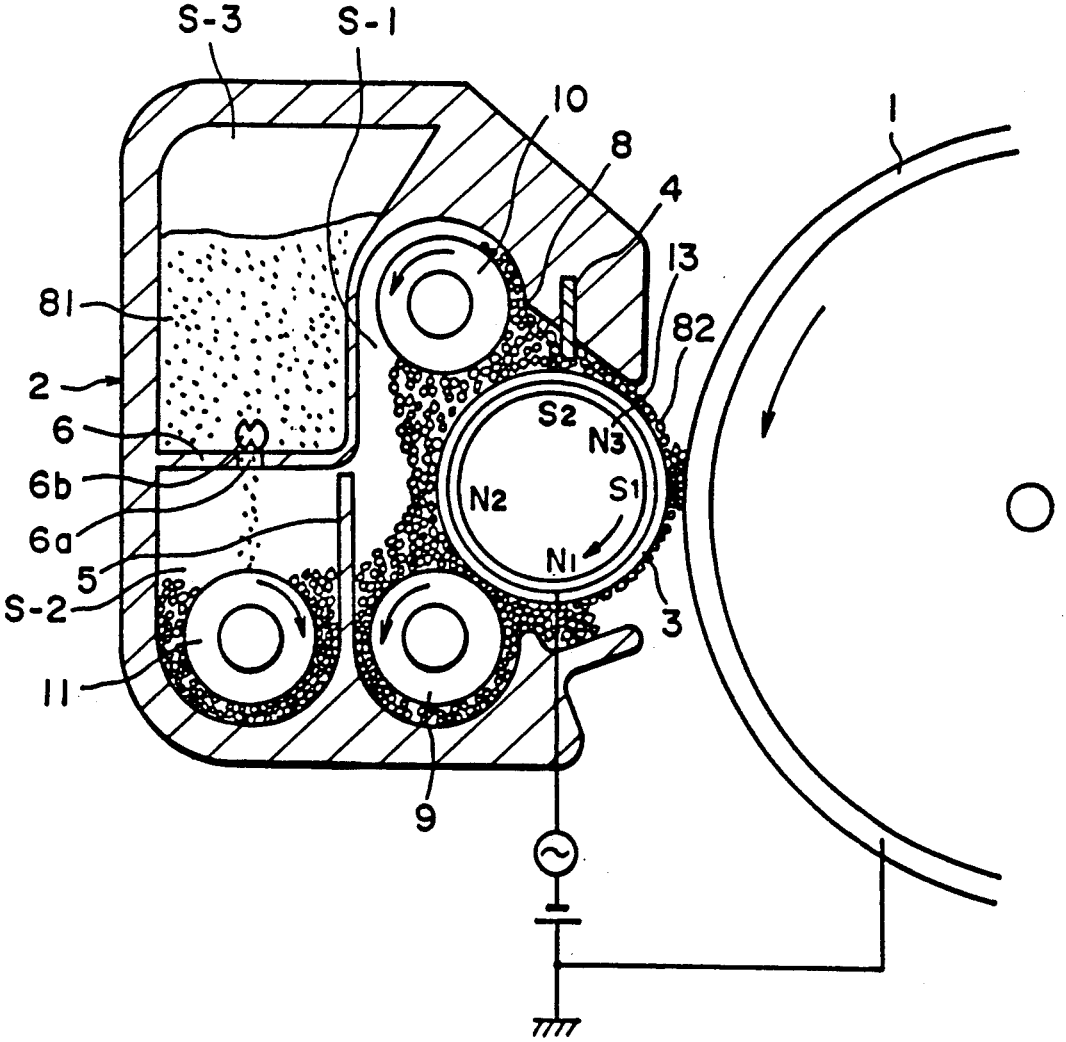

The magnet of Example 2 was used, and the developing apparatus shown in FIG. 4 was used. More particularly, to the developing apparatus used in Example 2, an elastically flexible sheet 12 made of polyethylene terephthalate film or the like is mounted to prevent the scattering.

An end of the scattering preventing sheet 12 is fixed to the covering member 14, and the other end is a free end. The surface thereof at the free end is ightly contacted to the developer at a position upstream of the maximum magnetic flux density position by the conveying pole.

Without the scattering preventing sheet, the scattering of the developer was at a tolerable level, but the provision of the sheet further decreases the scattering to an excellent extent.

As regards the developer conveying performance, it was as good as in Example 2.

EXAMPLE 4

The conditions were the same as Example 1 except that magnet 13 in FIG. 5 has the characteristics of magnet C listed in Table 1 C. With this structure, the developer conveying performance and the developer scattering prevention effects were both excellent.

As described in the foregoing, the configuration of the magnetic flux density distribution of the conveying pole which is immediately downstream of the developing pole is significantly influential to the developer conveying performance by the conveying pole. The experiments inventors have further revealed that the conveying performance from the developing pole to the conveying pole is improved in a different manner by the configuration of the magnetic flux density distributions of the developing pole and the conveying pole.

Figure 6:
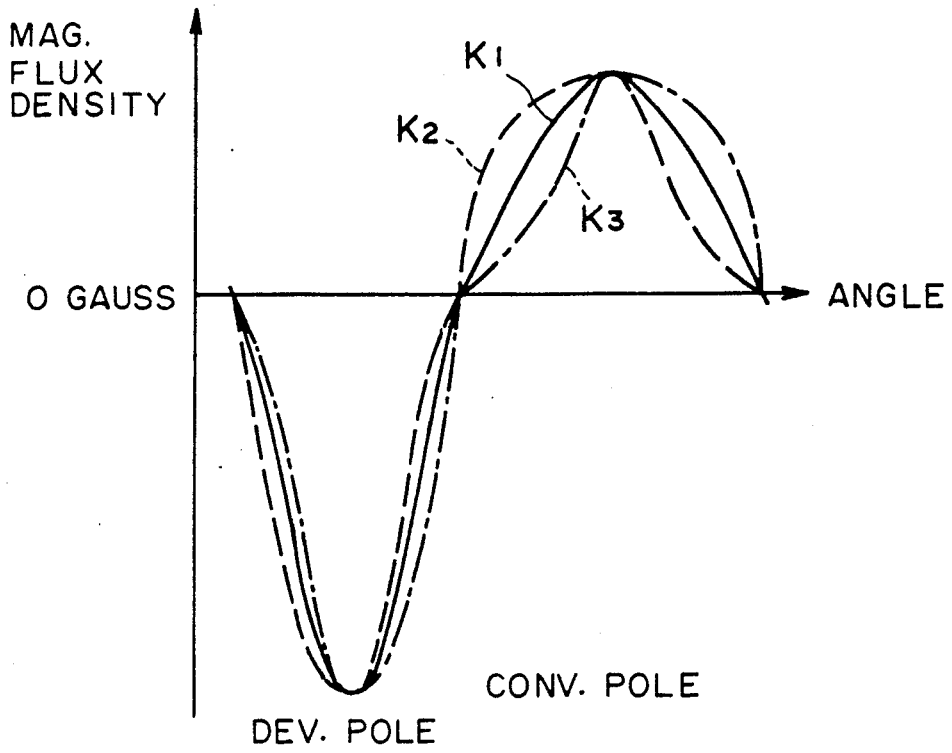
FIGS. 6 and 7 illustrate the magnetic flux density distribution of the developing magnetic pole and the conveying magnetic pole.
Figure 7:
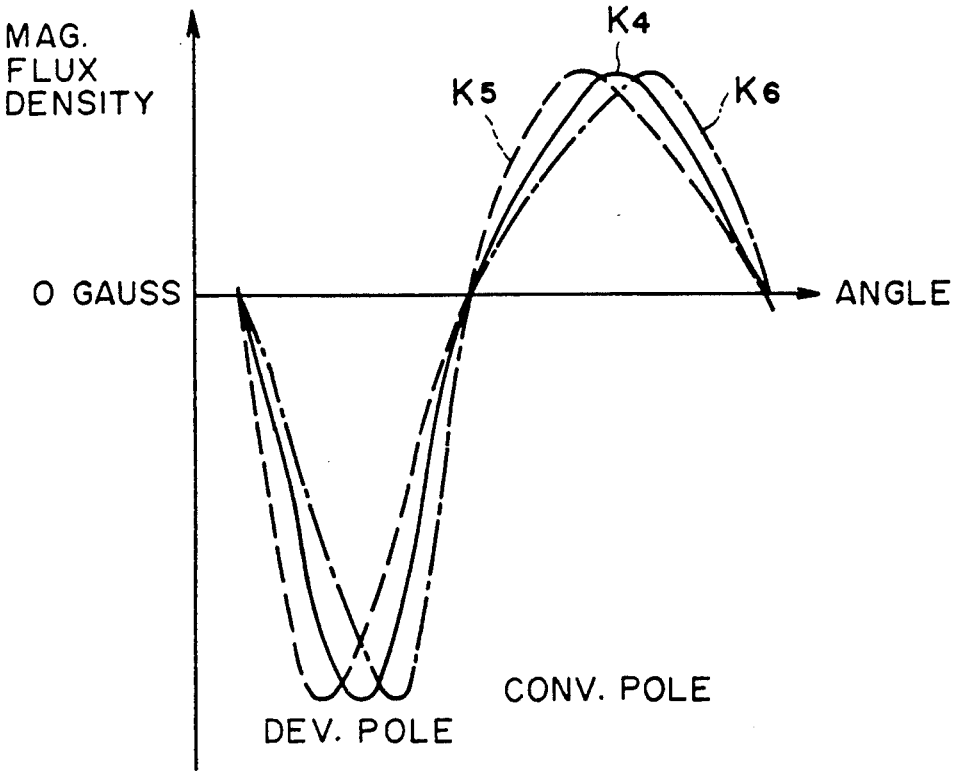

Referring to FIGS. 6 and 7, the description will be further made. In each of these Figures, the abscissa represents an angle as seen from the center of the sleeve, and the ordinate represents a magnetic flux density.

FIG. 6 deals with the relationship between (X50/X0) and (Y50/Y0). At the respective poles, the solid line K1 is plots of (X50/X0)=(Y50/Y0); the broken line K2 is plots of (X50/X0)>(Y50/Y0); and chain line K3 is plots of (X50X0)<(Y50/Y0).

With respect both to the developing pole and the conveying pole, the developer conveying performance was better in the configuration K2 of the magnetic flux density distribution than in the configuration K1, which is better than the configuration K3. Even if the configurations of the magnetic flux density distribution of the developing pole were K1 or K3, the conveying performance by the conveying pole was improved if the conveying pole had the magnetic flux density distribution K2. The developer conveying performance was best, however, when both of the magnetic flu density distributions provided by the magnetic poles are K2 configuration.

FIG. 7 shows the relationship between X0 and Y0, wherein a solid line K4 is plots of X0=Y0; a broken line K5 is plots of where X0<Y0; and chain line K6 are plots where X0>Y0.

With respect both to the developing pole and the conveying pole, the developer conveying performance was better in the magnetic flux density distribution configuration K5 than in K4 which is better than in K6.

As regards the conveying pole, if the consideration is paid only to the developer conveying performance, the order of the preference is K5, K4 and K6. However, the reduction of the distance between the conveying pole and the developing pole involves a limit in connection with the other factors, and the reduction is disadvantageous for the scattering of the developer.

Therefore, in some cases the distribution K6 (X0 and Y0 of the conveying pole) is preferable. Even if the developer conveying performance is slightly reduced by using the K6 configuration for X0 and Y0 of the conveying pole, the developer conveyance performance may be made sufficiently good by using the magnetic flux density distribution K2 for the conveying pole, preferably using the magnetic flux density distribution K2 or K4 for the developing pole. More particularly, when the developing pole and the conveying pole are not sufficiently remote, it is preferable that the conveying pole has the distribution K6 (X0>Y0) from the standpoint of the developer scatter prevention.

The magnetic flux density distributions described above may be obtained by bonding plural magnets in proper orientations, by magnetizing a roller in proper patterns or by cutting away a part of magnet roller or the like.

A magnetic member may be mounted adjacent to the conveying magnetic pole to retain the brush of the developer erected or to deflect the direction of the erected brush away from the developing magnetic pole, by which the brush is made remote from the region in which the retracting magnetic force $f\theta$ is influential.

In the foregoing embodiments, a so-called pole position development has been dealt with wherein the developing operation is performed wherein the brush is erected by the developing pole. However, the present invention is applicable to the case of a so-called between-poles development wherein the closest position between the sleeve and the drum is placed between two magnetic poles having opposite polarities to form a laid-down magnetic brush without direct contact to the drum.

In this case, the downstream one of the developing magnetic poles sandwiching the closest position and a magnetic pole downstream of the downstream developing pole are made to satisfy the relation described in the foregoing.

The present invention is also applicable to a developing apparatus using a developer which a mixture of magnetic toner and small size magnetic carrier particles. Further, the present invention is applicable to a one component magnetic developer. Therefore, the present invention is applicable to a developing device using a developer containing magnetic materials.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member, comprising:

a developer container for containing a developer comprising magnetic material;

a rotatable developer carrying member for being supplied with the developer from said developer container and for carrying the developer through a developing zone where said developer carrying member is disposed facing said image bearing member;

a magnetic stationarily disposed in said developer carrying member, wherein said magnet has a first magnetic pole for forming a magnetic field in the developing zone, a second magnetic pole being disposed downstream of said first magnetic pole with respect to a rotational direction of said developer carrying member and having a magnetic polarity opposite to that of said first magnetic pole, and a third magnetic pole disposed downstream of said second magnetic pole with respect to the direction and disposed adjacent to said second magnetic pole, wherein said second magnetic pole has a magnetic flux density satisfying (X50/X0)>(Y50/Y0)

where X0 is a distance from a position $B_p$ of a maximum magnetic flux density of a one pole to a boundary between the one pole and the upstream adjacent magnetic pole, measured along the circumference of said developer carrying member; Y0 is a distance from the position $B_p$ to a boundary between the one magnetic pole and the downward adjacent magnetic pole, measured along the circumferential periphery of said developer carrying member; X50 and Y50 are distances from the position $B_p$ to the upstream and downstream positions where the magnetic flux density by the one magnetic pole is one half the maximum magnetic flux density, measured along the circumferential periphery of said developer carrying member.

2. An apparatus according to claim 1, wherein said first magnetic pole has a maximum magnetic flux density which is larger than that of said second magnetic pole.

3. An apparatus according to claim 2, wherein said first magnetic pole has a magnetic flux density having a distribution satisfying $X0 < Y0$.

4. An apparatus according to claim 2, wherein aid first magnetic pole has a magnetic flux density having a distribution satisfying $(X50/X0) > (Y50/Y0)$.

5. An apparatus according to claim 4 wherein said second magnetic pole has a magnetic flux density having a distribution satisfying $X0 > Y0$.

6. An apparatus according to any one of claims 1–5, further comprising a covering member extending upstream beyond the $B_p$ position of the second magnetic pole with respect to the direction to cover said developer carrying member.

7. An apparatus according to any one of claims 1–5, further comprising a flexible sealing member contactable to a layer of the developer carried on said developer carrying member at a free end portion of said flexible sealing member at a position upstream of the $B_p$ position of said second magnetic pole.

8. An apparatus according to any one of claims 1–5, wherein said developer carrying member carries the developer comprising toner particles and the magnetic carrier particles having a weight average particle size of 20–65 microns.

9. An apparatus according to claim 8, further comprising a regulating member for regulating a thickness of a layer of the developer to be conveyed to the developing zone by said developer carrying member, wherein said regulating member is spaced away from the developer carrying member with a gap of 50–900 microns.

10. A developing apparatus according to claim 9, further comprising a voltage source for applying an alternating bias voltage to said developer carrying member.

11. A developing apparatus according to claim 10, wherein said first magnetic pole has a maximum magnetic flux density on said developer carrying member which is larger than 900 Gauss.

* * * * *

UNITED STATES PATENT AND TRADEMARK OFFICE

CERTIFICATE OF CORRECTION

PATENT NO. : 5,051,782

DATED : September 24, 1991

INVENTOR(S) : MASAAKI YAMAJI

It is certified that error appears in the above-identified patent and that said Letters Patent is hereby corrected as shown below:

COLUMN 1

Line 49, "memmber" should read --member.--.

COLUMN 2

Line 9, "containing a" should read --contains--.
Line 21, "effective" should read --effectively--.

COLUMN 3

Line 13, "f0" should read --fθ--.
Line 18, "f0" should read --fθ--.

COLUMN 4

Line 49, "eans," should read --means,--.

COLUMN 5

Line 35, "comprises" should read --comprising--.
Line 50, "to" should be deleted.
Line 53, "tends" should read --tending--.
Line 57, "the" should be deleted.
Line 59, "have" should read --has--.

COLUMN 6

Line 30, "laten" should read --latent--.
Line 45, "tends" should read --tend--.
Line 55, "pol" should read --pole--.
Line 68, "out side" should read --outside--.

UNITED STATES PATENT AND TRADEMARK OFFICE

CERTIFICATE OF CORRECTION

PATENT NO. : 5,051,782

DATED : September 24, 1991

INVENTOR(S) : MASAAKI YAMAJI

It is certified that error appears in the above-identified patent and that said Letters Patent is hereby corrected as shown below:

COLUMN 8

Line 4, "Example ∝" should read --Example 4--.
Line 49, "pole" should read --poles--.

COLUMN 11

Line 5, "Table 1C." should read --Table 1.--.
Line 38, "flu" should read --flux--.

COLUMN 12

Line 28, "which" should read --which is--.
Line 52, "magnetic" should read --magnet--.

COLUMN 13

Line 22, "aid" should read --said--.
Line 25, "claim 4" should read --claim 4,--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*